US007355494B2

(12) United States Patent
Kosaka

(10) Patent No.: US 7,355,494 B2
(45) Date of Patent: Apr. 8, 2008

(54) BAND-PASS FILTER

(75) Inventor: Takeshi Kosaka, Haruna-Machi (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 283 days.

(21) Appl. No.: 11/217,227

(22) Filed: Sep. 1, 2005

(65) Prior Publication Data

US 2006/0049898 A1 Mar. 9, 2006

(30) Foreign Application Priority Data

Sep. 3, 2004 (JP) ..... 2004-257122

(51) Int. Cl.
*H01P 1/203* (2006.01)

(52) U.S. Cl. ..... 333/204; 333/205

(58) Field of Classification Search ..... 333/175, 333/176, 204, 205
See application file for complete search history.

(56) References Cited

U.S. PATENT DOCUMENTS 3,605,045 A 9/1971 Ramsbotham, Jr.
4,382,238 A * 5/1983 Makimoto et al. ..... 333/134
5,576,672 A 11/1996 Hirai et al.
5,648,747 A 7/1997 Grothe et al.
6,529,096 B2 * 3/2003 Maekawa et al. ..... 333/134
6,603,372 B1 * 8/2003 Ishizaki et al. ..... 333/204

FOREIGN PATENT DOCUMENTS

EP 1 160 907 A2 12/2001
EP 1 443 587 A1 8/2004
JP 11017405 A * 1/1999

* cited by examiner

*Primary Examiner*—Seungsook Ham
(74) *Attorney, Agent, or Firm*—Knobbe Martens Olson & Bear, LLP

(57) ABSTRACT

A base band of a λa wave generated by a λa/4 resonator is used as it is, a triple wave of the λa wave generated by the resonator is shifted to a low frequency side, and the fundamental wave and the triple wave are complemented by a pass band, generated by a λb/2 resonator. Consequently, a flat pass characteristic is secured in a band from the fundamental wave to the triple wave.

11 Claims, 10 Drawing Sheets

BAND-PASS FILTER

BACKGROUND OF THE INVENTION

1. Field of the Invention

The present invention relates to a filter, and, in particular to a filter that is effective for realizing broadening of a pass band while satisfying requirements for a small size and a low loss.

2. Description of the Related Art

A band-pass filter for attenuating unnecessary components such as higher harmonics is used in a high-frequency circuit unit of a radio communication apparatus or the like. As the band-pass filter of this type, a filter using a dielectric resonator having a compact structure, with which a satisfactory damping property is obtained, is mainly used. In particular, a distributed constant type filter, which utilizes a strip line as a resonator formed in a dielectric, is widely used.

As the distributed constant type filter of this type, for example, a method described in JP-A-11-17405 is known. JP-A-11-17405 discloses a method of constituting a band-pass filter or a band elimination filter by coupling a λ/4 strip line and a λ/2 strip line.

In recent years, as in an Ultra Wide Band (UWB) system, a filter is required to broaden a band such that the band has a fractional band width (a pass band width/a center frequency) close to 100% or a higher fractional band width.

However, in the conventional designing method for a band-pass filter and the method disclosed in JP-A-11-17405, it is necessary to form a large number of resonators in multiple stages in order to realize broadening of a pass band. Increasing the number of stages of resonators in this way involves an increase in a size of a filter and an increase in an insertion loss.

In particular, in realizing an ultra-wide-band such as the UWB system, a necessary band is not obtained by two to three stages of resonators. Thus, it is difficult to provide a small and low-loss filter with the conventional method.

SUMMARY OF THE INVENTION

Thus, one object of the invention is to provide a filter that is effective for realizing broadening of a pass band, and another object of the present invention is provide the filter which satisfies requirements for a small size and a low loss.

In order to attain at least one of the objects, in a filter according to a first aspect of the invention, a pair of λa/4 resonators is coupled by a λb/2 resonator.

Consequently, plural pass bands formed by the λa/4 resonators can be complemented by a pass band formed by the λb/2 resonator. This makes it possible to broaden a pass band with a filter having a size and a loss smaller and lower than those of a filter that has a pass band obtained by forming λ/4 resonators in multiple stages. Note that, when a large size is allowed and it is desired to realize further broadening of a pass band, combined units of the λa/4 resonators and the λb/2 resonator may be formed in multiple stages.

In a filter according to a second aspect of the invention, a pass band corresponding to a λa wavelength and a pass band corresponding to a λa×3 wavelength are formed by a pair of λa/4 resonators and are complemented by a pass band corresponding to a λb wavelength formed by a λb/2 resonator.

A flat pass band from a fundamental wave to a triple wave can be obtained by complementing a λa wave and a λa×3 wave with a λb wave in this way. This makes it possible to perform broadening of a pass band, realization of which is difficult only with the λa/4 resonator. In this case, it is desirable to set λa and λb, which determine resonance conditions of the respective resonators, according to a relation of $\lambda a<\lambda b<\lambda a\times 3$.

In a filter according to a third aspect of the invention, a base pass band formed by a first resonator and a harmonic band of the base pass band are complemented by a pass band formed by a second resonator.

A fundamental wave and a harmonic formed by a first resonator can be complemented by another resonator in this way. This makes it possible to use a harmonic band, which has been conventionally treated as an unnecessary band, for broadening of a pass band.

In a filter according to a fourth aspect of the invention, a strip line structure is constituted by arranging a resonant electrode between a pair of GND electrodes. In a specific embodiment, the resonant electrode includes first and second λa/4 resonant electrodes and a λb/2 resonant electrode coupled with the λa/4 resonant electrodes.

The λa/4 resonant electrodes and the λb/2 resonant electrode can be constituted in the strip line structure in this way. This makes it possible to effectively utilize a harmonic band that tends to appear in a strip line resonator.

In a filter according to a fifth aspect of the invention, a strip line structure is constituted by holding a resonant electrode formed on a dielectric layer with a pair of GND electrodes. In a specific embodiment, the resonant electrode includes a pair of λa/4 resonant electrodes formed on a first dielectric layer and a λb/2 resonant electrode formed on a second dielectric layer. The pair of λa/4 resonant electrodes and the λb/2 resonant electrode are capacitively coupled via the second dielectric layer.

The first dielectric layer, on which the λa/4 resonant electrodes are formed, and the second dielectric layer, on which the λb/2 resonant electrode is formed, can be stacked in this way. This makes it possible to couple these dielectric layers suitably.

In a filter according to a sixth aspect of the invention, a strip line structure is constituted by arranging a resonant electrode between first and second GND electrodes. In a specific embodiment, the resonant electrode includes first and second λa/4 resonant electrodes and a λb/2 resonant electrode coupled with the λa/4 resonant electrodes. A combination of the resonant electrodes may be arranged near the first or the second GND electrode.

It is possible to shift a triple wave caused by λa/4 resonance to a low frequency side by arranging a resonant electrode area near one of the GND electrodes in this way. This makes it possible to realize complement between a fundamental wave and a triple wave by λb/2 resonance with a low loss.

In all of the aforesaid embodiments, any element used in an embodiment can interchangeably be used in another embodiment unless such a replacement is not feasible or causes adverse effect. Further, the present invention can equally be applied to apparatuses and methods. For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention. The drawings are oversimplified, especially with regard to dimensions, for illustrative purposes.

DESCRIPTION OF THE EMBODIMENTS

Embodiments of the invention will be hereinafter explained in detail with reference to the accompanying drawings. Note that the embodiments explained below are not intended to limit the invention, and one of ordinary skill in the art could make modifications according to circumstances.

Figure 1:
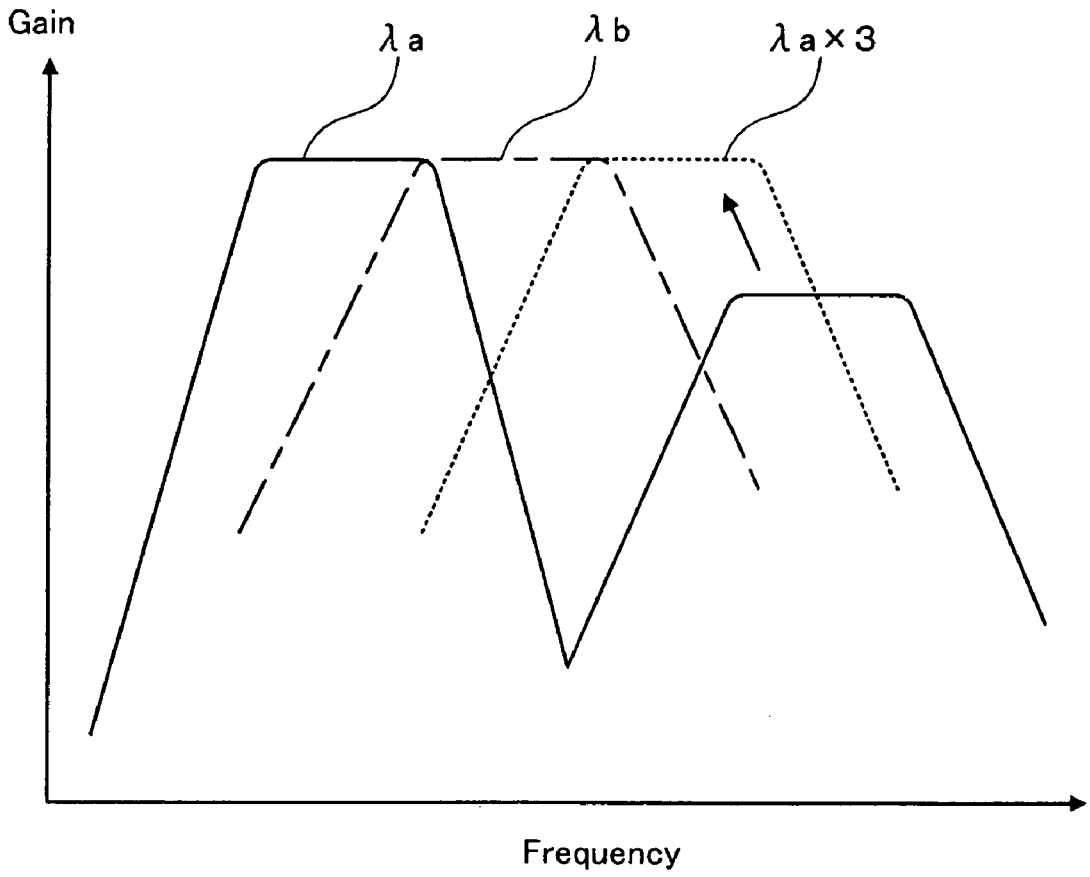
FIG. 1 is a conceptual diagram showing an idea of broadening of a pass band according to an embodiment of the invention.

FIG. 1 is a conceptual diagram showing an idea of broadening of a pass band according to an embodiment of the invention. As shown in the figure, the broadening of a pass band can be realized by improving a pass characteristic, which is indicated by a solid line in the figure, generated by a λ/4 resonator.

As a specific example, a base band of a λa wave generated by a λa/4 resonator is used as it is, a triple wave of the λa wave generated by the resonator is shifted to a low frequency side as indicated by a dotted line in the figure, and the fundamental wave and the triple wave are complemented by a pass band, which is indicated by a chain line in the figure, generated by a λb/2 resonator. Consequently, a flat pass characteristic can be secured in a band from the fundamental wave to the triple wave.

Figure 2:
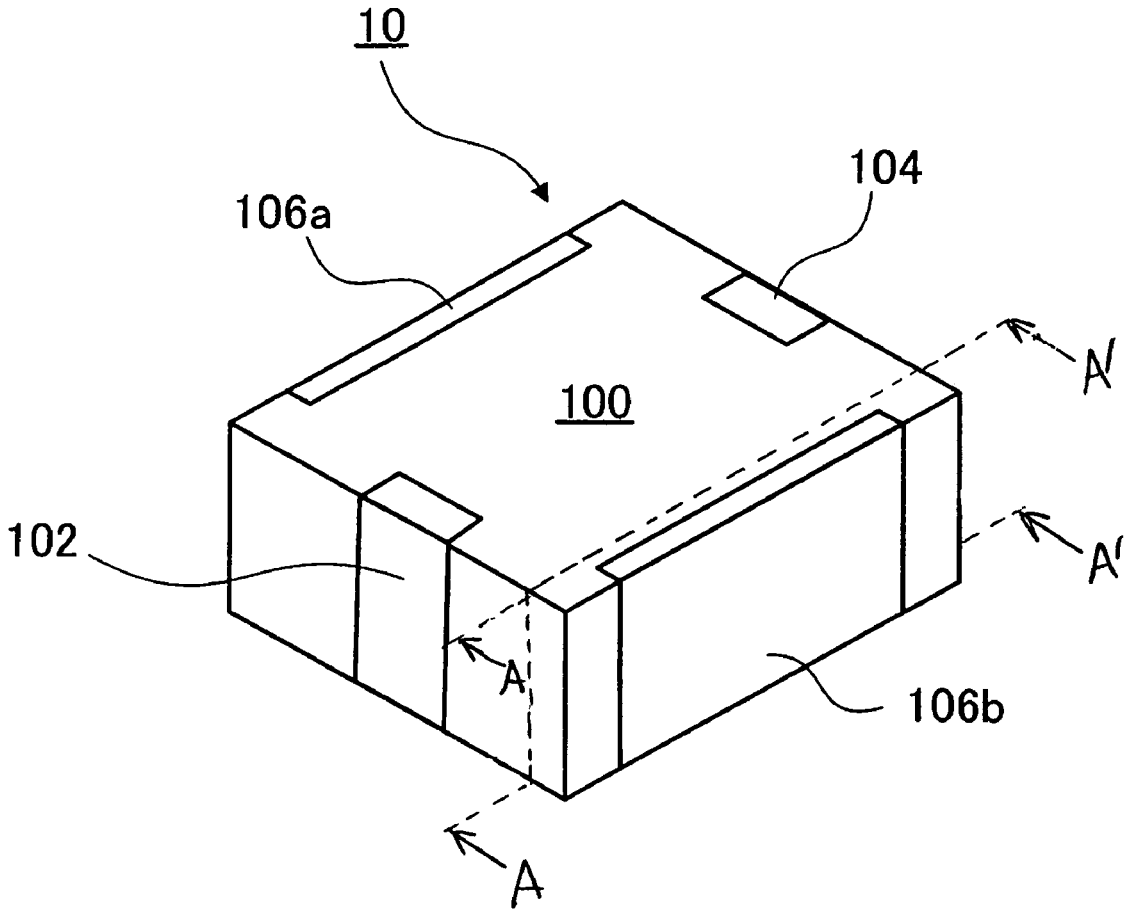
FIG. 2 is a perspective view showing an external structure of a filter according to an embodiment of the invention.

FIG. 2 is a perspective view showing an external structure of a filter according to this embodiment. As shown in the figure, in the filter, an input external electrode terminal 102, an output external electrode terminal 104, and GND external electrode terminals 106*a* and 106*b* are formed on a surface of a bulk dielectric 100. The filter can be connected with a not-shown circuit substrate via these electrode terminals.

Figure 3:
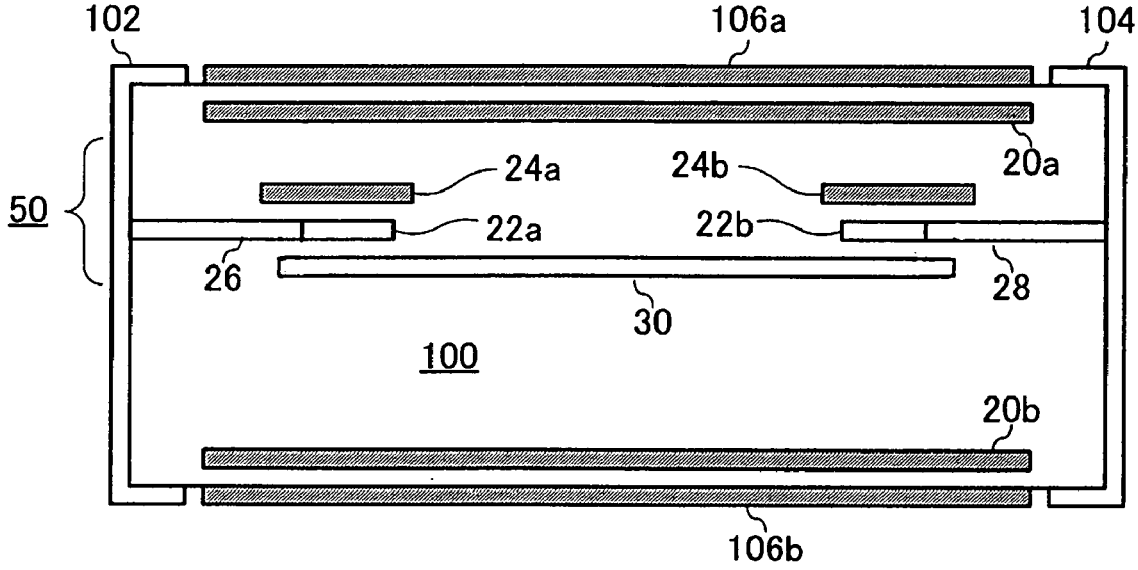
FIG. 3 is a sectional view along line A-A' in FIG. 2.

FIG. 3 is a sectional view along the line A-A' in FIG. 2. As shown in the figure, the filter includes plural internal layer electrodes in the dielectric 100. These internal layer electrodes are arranged in a predetermined relation. The filter has a strip line structure in which a resonant electrode forming area 50 is held by a pair of GND electrodes 20*a* and 20*b*. The resonant electrode forming area 50 includes an input electrode 26 connected to the input external electrode terminal 102, an output electrode 28 connected to the output external electrode terminal 104, λ/4 resonant electrodes 22*a* and 22*b* provided to be coupled with the input electrode 26 and the output electrode 28, respectively, wavelength reduction effective electrodes 24*a* and 24*b* coupled to free end sides of the resonant electrodes, and a λ/2 coupling electrode 30 capacitively coupled to the resonant electrodes.

The λ/4 resonant electrodes 22*a* and 22*b* are formed of a strip line pattern having an electric length that is ¼ of a wavelength λa. The λ/2 coupling electrode 30 is formed of a strip line pattern having an electric length that is ½ of a wavelength λb set on a higher frequency side than the wavelength λa. The λ/4 resonant electrodes 22*a* and 22*b* are coupled at both ends of the λ/2 coupling electrode 30.

As shown in the figure, it is possible to shift a frequency, at which a triple wave appears, to a low frequency side by disposing an overall arrangement of the resonant electrode forming area 50 closer to the upper GND electrode 20*a* than to the lower GND electrode 20*b*. This makes it possible for the filter to secure sufficient pass and reflection characteristics when complement by the λ/2 resonator is performed.

Figure 4:
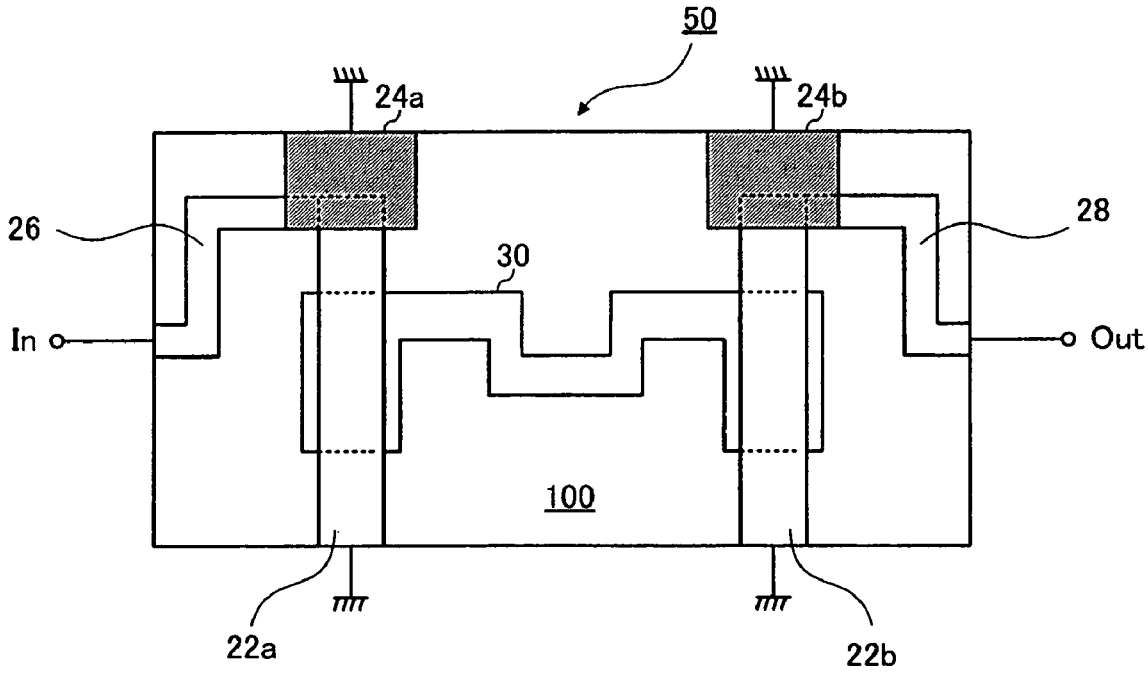
FIG. 4 is a plan view showing a constitution of a resonant electrode forming area 50 shown in FIG. 3.

FIG. 4 is a plan view showing a constitution of the resonant electrode forming area 50 shown in FIG. 3. As shown in the figure, one ends of the λ/4 resonant electrodes 22*a* and 22*b* are short circuited and the other ends are opened. The λ/2 coupling electrode 30 is arranged in a position facing against the λ/4 resonant electrodes 22*a* and 22*b*. It is possible to adjust a frequency characteristic obtained by changing the opposing areas of the λ/4 resonant electrodes 22*a* and 22*b* and the λ/2 coupling electrode 30 and the pattern shape of the λ/2 coupling electrode 30.

The wavelength reduction effective electrodes 24*a* and 24*b* which are grounded and the input electrode 26 and the output electrode 28 are arranged on the free end side of the λ/4 resonant electrodes 22*a* and 22*b*, respectively, so as to be opposed to each other. The wavelength reduction electrode is an electrode for reducing a wavelength of a λ/4 resonant electrode and realizing a reduction in a size thereof. The input electrode and the output electrode are electrodes for leading out the λ/4 resonant electrode to external input and output terminals. Note that, in the embodiment of the invention, a configuration in which the wavelength reduction effective electrode is not provided or a configuration in which the input electrode and the output electrode are formed in the layer in which the λ/4 resonant electrodes are formed may be adopted.

Figure 5A:
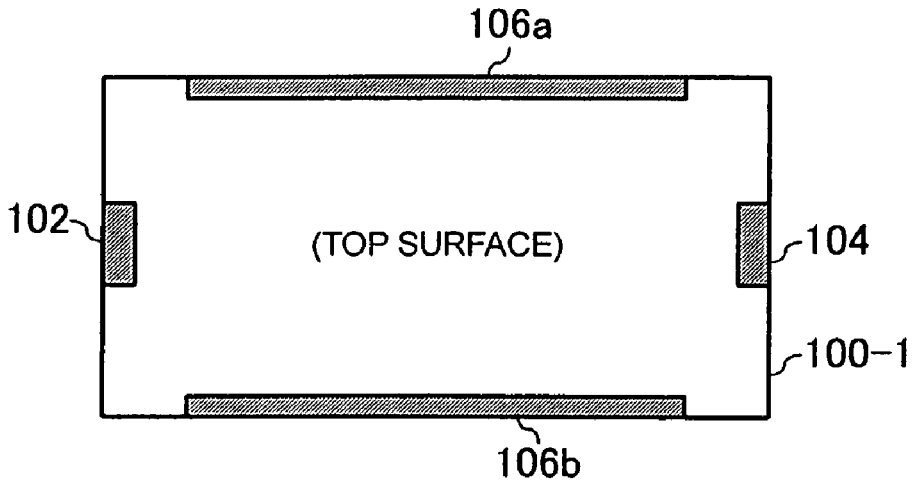
FIGS. 5A and 5B are first disassembled plan views showing a layer structure of the filter shown in FIG. 2.
Figure 5B:
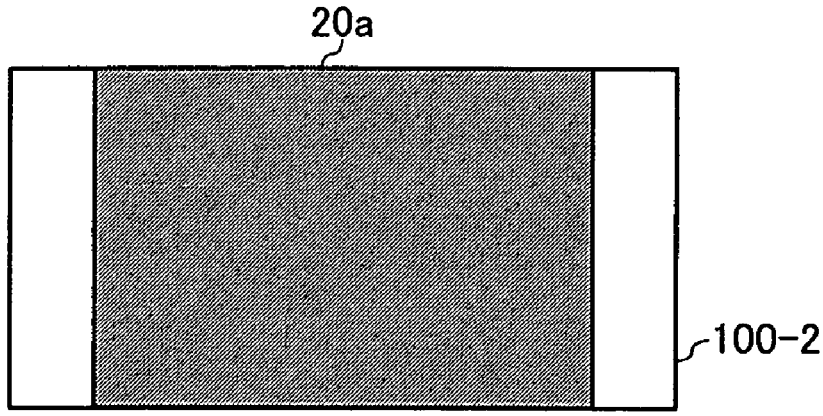

FIGS. 5A and 5B are first disassembled plan views showing a layer structure of the filter shown in FIG. 2. As shown in FIG. 5A, the input external electrode terminal 102, the output external electrode terminal 104, and the GND external electrode terminals 106*a* and 106*b* are formed on a first dielectric layer 100-1. A top surface of the filter includes these terminals.

As shown in FIG. 5B, on a second dielectric layer 100-2, the GND electrode 20*a* is formed in contact with the GND external electrode terminals 106*a* and 106*b*. The second dielectric layer 100-2 is arranged under the first dielectric layer 100-1 shown in FIG. 5A.

Figure 6:
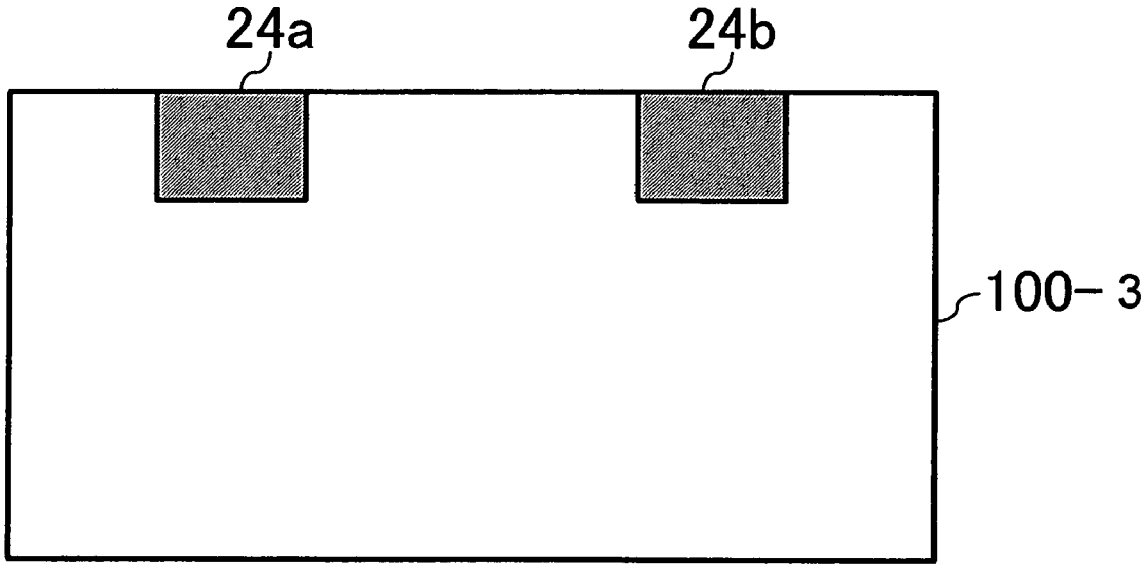
FIG. 6 is second disassembled plan views showing a layer structure of the filer shown in FIG. 2.

FIG. 6 is second disassembled plan views showing a layer structure of the filter shown in FIG. 2. As shown in this figure, on a third dielectric layer 100-3, the wavelength reduction electrodes 24*a* and 24*b* are formed in contact with the GND external electrode terminal 106*a*. The third dielectric layer 100-3 is arranged under the second dielectric layer 100-2 shown in FIG. 5.

Figure 7A:
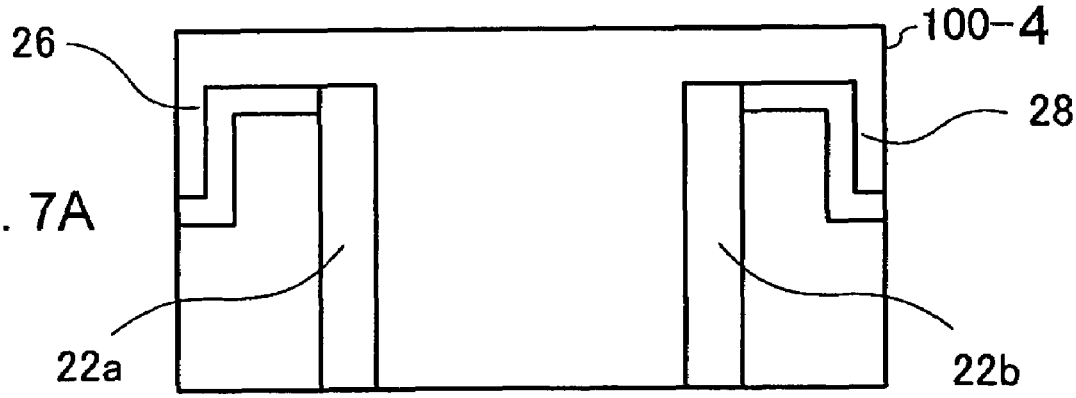
FIGS. 7A and 7B are third disassembled plan views showing a layer structure of the filter shown in FIG. 2.
Figure 7B:
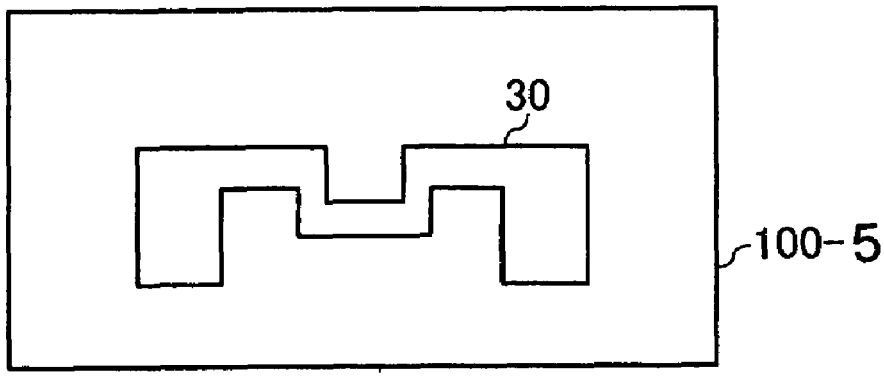

FIGS. 7A and 7B are third disassembled plan views showing a layer structure of the filter shown in FIG. 2. As shown in FIG. 7A, on a fourth dielectric layer 100-4, the input electrode 26 and the output electrode 28 are formed in contact with the input external electrode terminal 102 and the output external electrode terminal 104, respectively.

The fourth dielectric layer 100-4 is arranged under the third dielectric layer 100-3 shown in FIG. 6. The λ/4 resonant electrodes 22*a* and 22*b* have one ends which are short circuited and the other ends which are opened, providing strip-line structure. These short ends 22*a* and 23*b* are connected to the GND electrode 106*b*.

As shown in FIG. 7B, on a fifth dielectric layer 100-5, the λ/2 coupling electrode 30 is formed to be opposed to the λ/4 resonant electrodes. The fifth dielectric layer 100-5 is arranged under the fourth dielectric layer 100-4 shown in FIG. 7A.

Figure 8A:
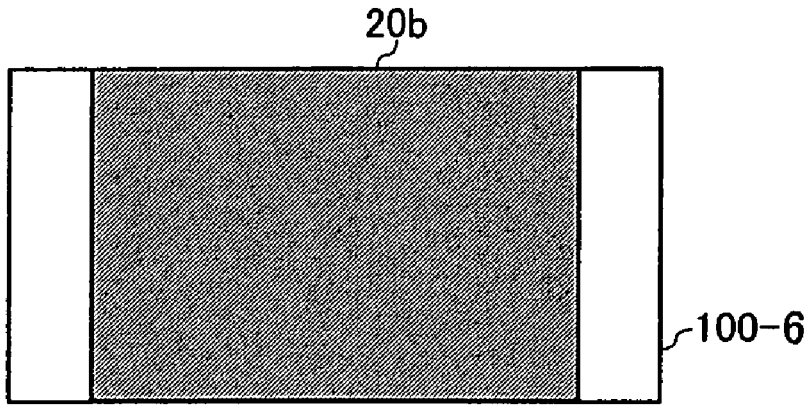
FIGS. 8A and 8B are fourth disassembled plan views showing a layer structure of the filter shown in FIG. 2.
Figure 8B:
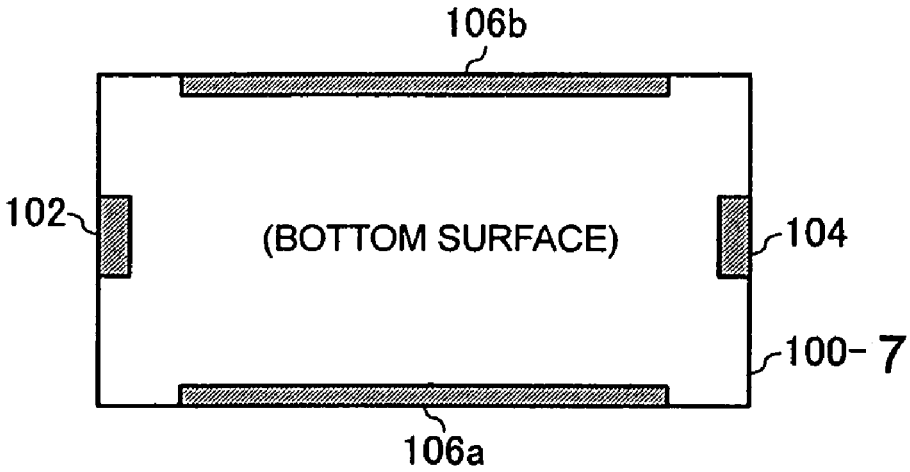

FIGS. 8A and 8B are fourth disassembled plan view showing a layer structure of the filter shown in FIG. 2. As shown in FIG. 8A, on a sixth dielectric layer 100-6, the GND electrode 20*b* is formed in contact with the GND external electrode terminals 106*a* and 106*b*. The sixth dielectric layer 100-6 is arranged under the fifth dielectric layer 100-5 shown in FIG. 7B.

As shown in FIG. 8B, the input external electrode terminal 102, the output external electrode terminal 104, and the GND external electrode terminals 106*a* and 106*b* are formed on a seventh dielectric layer 100-7. A bottom surface of the filter includes these terminals. The seventh dielectric layer 100-7 is arranged under the sixth dielectric layer 100-6 shown in FIG. 8A.

The dielectric layers 100-1 to 100-7 are formed integrally through stacking and baking processes and completed as a laminated filter including plural dielectric layers. Note that it is desirable to form the external electrode terminals 102 to 106 through application or plating after the stacking and baking. Other intermediate layers may be intervened among the dielectric layers 100-1 to 100-7.

Figure 9:
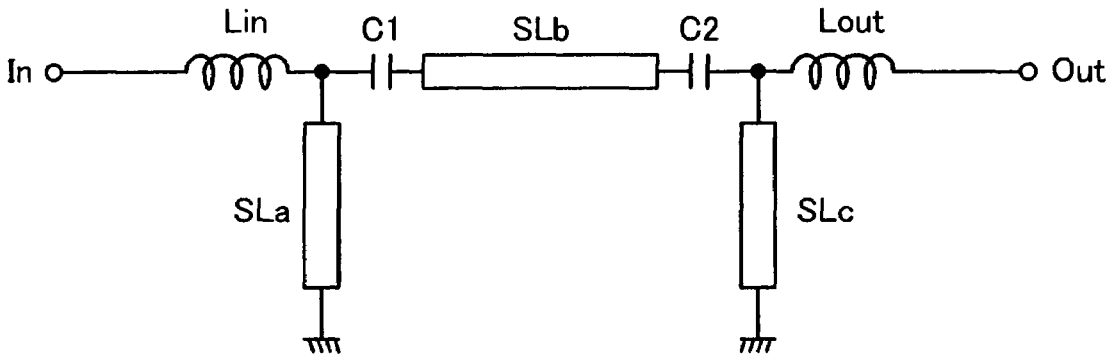
FIG. 9 is a circuit diagram showing an equivalent circuit of the filter shown in FIG. 2.

FIG. 9 is a circuit diagram showing an equivalent circuit of the filter shown in FIG. 2. As shown in the figure, the filter has an equivalent structure in which, between two distributed constant λ/4 resonators SLa and SLb, a λ/2 resonator SLb having a resonant frequency between frequencies of a fundamental wave and a triple wave of the resonators SLa and SLb is connected via coupling capacitors C1 and C2. Lin and Lout shown in the figure indicate inductance components of the input electrode 26 and the output electrode 28.

With such an equivalent circuit, filter waveforms formed by resonance due to a fundamental wave and a triple wave of distributed constant λ/4 resonators are complemented by a filter waveform formed by resonance generated by a λ/2 resonator. This makes it possible to constitute a broadband filter equivalent to five stages with three resonators in total, namely, two λ/4 resonators and one λ/2 resonator.

Figure 10:
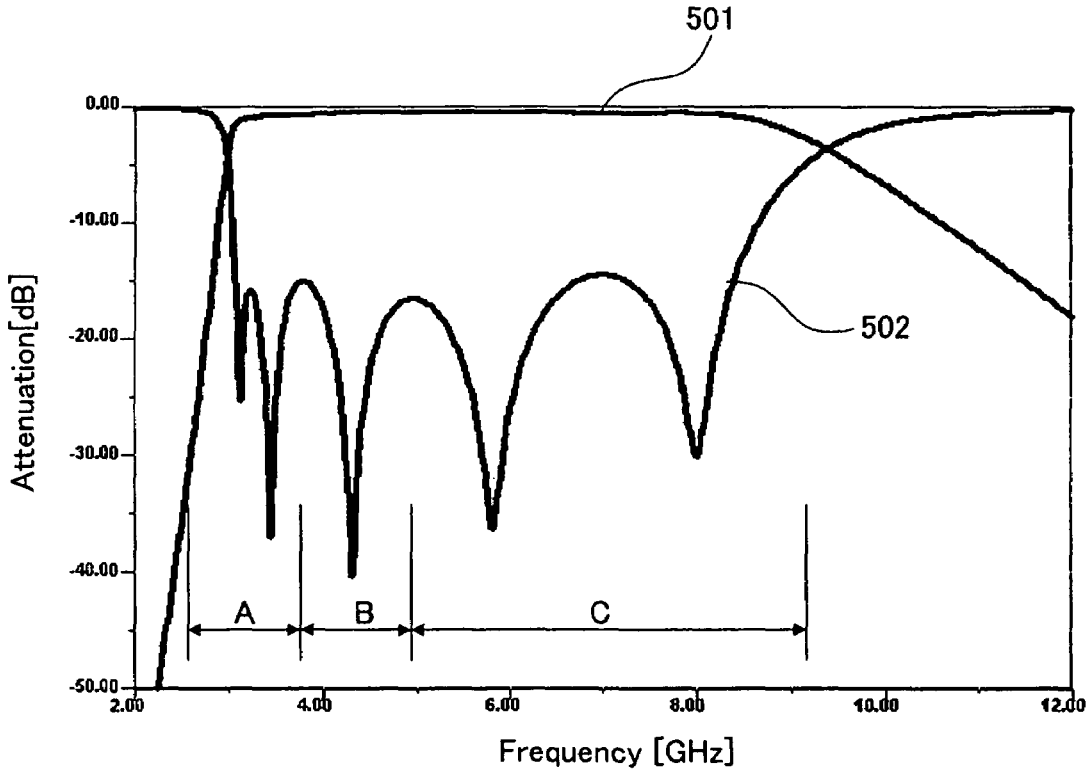
FIG. 10 is a characteristic chart showing pass and reflection characteristics of the filter shown in FIG. 2.

FIG. 10 is a characteristic chart showing pass and reflection characteristics of the filter shown in FIG. 2. As shown in the figure, a pass characteristic 501 of the filter covers a broadband of 3 GHz to 8 GHz sufficiently. In addition, a reflection characteristic 502 in the band is satisfactory.

In the figure, an area denoted by reference sign A is equivalent to a resonant area generated by fundamental waves of the λ/4 resonators, an area denoted by reference sign B is equivalent to a resonant area of the λ/2 resonator, and an area denoted by a reference sign C is equivalent to a resonant area generated by triple waves of the λ/4 resonators.

Figure 11:
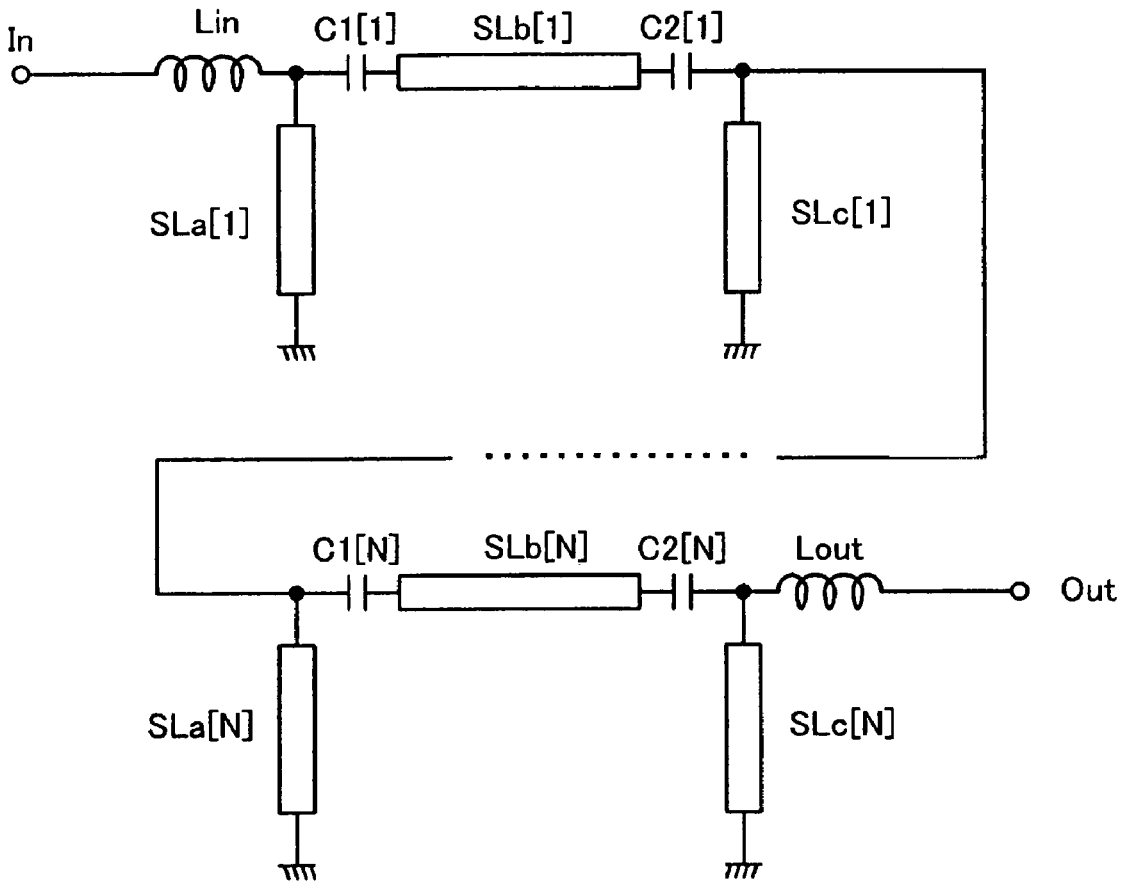
FIG. 11 is an equivalent circuit diagram of an example in which the equivalent circuit shown in FIG. 9 is formed in multiple stages.

FIG. 11 is an equivalent circuit diagram of an example in which the equivalent circuit shown in FIG. 9 is formed in multiple stages. As shown in the figure, in the invention, a basic unit of λ/4 resonators and a λ/2 resonator may be formed in multiple stages via coupling capacitors. A substantial number of stages in that case is (number of λ/4 resonators)×2+(number of λ/2 resonators).

As explained above, according to at least one embodiment of the invention, it is possible to realize broadening of a pass band while satisfying requirements for a small size and a low loss of a filter.

In an embodiment of this invention, any λ/4 resonators can be replaced for λ/2 resonators. In this case, the triple wave is replaced for double wave.

And in an embodiment of this invention, the GND electrode 20*a* shown in FIG. 5B can be removed. In this case, the strip-line structure becomes micro strip-line structure.

And in an embodiment of this invention, the reduction effective electrodes 24*a* and 24*b* can be removed. And the layers 100-3, 100-4, and 100-5 can be arranged in other oders.

The present application claims priority to Japanese Patent Application No. 2004-257122, filed Sep. 3, 2004, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A band-pass filter comprising:

a pair of resonators; and another resonator capacitively coupling the pair of resonators, said another resonator having frequency characteristics different from frequency characteristics of the pair of resonators, wherein:

the pair of resonators are λa/4 resonators, the another resonator is a λb/2 resonator, wherein λb is set on a higher frequency side than λa and satisfies a relation of λa<λb<λa×3, the pair of λa/4 resonators form a pass band corresponding to a λa wavelength and a pass band corresponding to a λa×3 wavelength, and the λb/2 resonator forms a pass band corresponding to a λb wavelength which complements a pass band between the pass band corresponding to the λa wavelength and the pass band corresponding to the λa×3 wavelength.

2. The filter according to claim 1, wherein the pair of resonators form a base pass band, and the another resonator forms a pass band which complements a harmonic band of the base pass band.

3. The filter according to claim 1, which has a strip line structure comprising:

an upper GND electrode and a lower GND electrode; and resonant electrodes arranged between the pair of GND electrodes, said resonant electrodes comprising:

(i) first and second λa/4 resonant electrodes which constitute the pair of resonators; and (ii) a λb/2 resonant electrode coupled with the λa/4 resonant electrodes, which constitutes the another resonator.

4. The filter according to claim 3, wherein the first and second λa/4 resonant electrodes are formed on a first dielectric layer; and the λb/2 resonant electrode is formed on a second dielectric layer, wherein the first and second λa/4 resonant electrodes and the λb/2 resonant electrode are capacitively coupled via the second dielectric layer.

5. The filter according to claim 3, wherein the resonant electrodes are arranged closer to one of the upper or lower GND electrode than to the other.

6. The filter according to claim 4, wherein the first and second λa/4 resonant electrodes each have one end which is short circuited and another end which is opened.

7. The filter according to claim 4, further comprising an input electrode and an output electrode formed on the first dielectric layer and connected to the first and second λa/4 resonant electrodes, respectively.

8. The filter according to claim 4, further comprising first and second wavelength reduction effective electrodes for reducing a wavelength of the λa/4 resonant electrodes, respectively, wherein the first and second wavelength reduction effective electrodes are formed on a third dielectric layer which is arranged between the upper and lower GND electrodes.

9. The filter according to claim 5, wherein the resonant electrodes are arranged to use a fundamental wave of the λa wave generated by the λa/4 resonators as is, shift a triple wave of the λa wave generated by the λa/4 resonators to a low frequency side, wherein the fundamental wave and the triple wave are complemented by a pass band generated by the λb/2 resonator.

10. The filter according to claim 9, which has a flat pass characteristic secured in a band from the fundamental wave to the triple wave.

11. A band-pass filter comprising:

a pair of resonators; and another resonator capacitively coupling the pair of resonators, said another resonator having frequency characteristics different from frequency characteristics of the pair of resonators, said band-pass filter having a strip line structure comprising:

an upper GND electrode and a lower GND electrode; and resonant electrodes arranged between the pair of GND electrodes, said resonant electrodes comprising:

(i) first and second λa/4 resonant electrodes which constitute the pair of resonators; and (ii) a λb/2 resonant electrode coupled with the λa/4 resonant electrodes, which constitutes the another resonator, wherein the first and second λa/4 resonant electrodes are formed on a first dielectric layer; and the λb/2 resonant electrode is formed on a second dielectric layer, wherein the first and second λa/4 resonant electrodes and the λb/2 resonant electrode are capacitively coupled via the second dielectric layer, said band-pass filter having a strip line structure further comprising first and second wavelength reduction effective electrodes for reducing a wavelength of the λa/4 resonant electrodes, respectively, wherein the first and second wavelength reduction effective electrodes are formed on a third dielectric layer which is arranged between the upper and lower GND electrodes.

* * * * *